United States Patent [19]

Segerljung

[11] 4,188,992

[45] Feb. 19, 1980

[54] BRAKE DEVICE FOR ROTATABLE AND SPRING LOADED RODS, FOIL OR CLOTH MATERIAL BEING ATTACHABLE TO SAID RODS

[76] Inventor: Bo V. Segerljung, Karlbergsvägen 10, Vallentuna, Sweden, 18600

[21] Appl. No.: 858,432

[22] Filed: Dec. 7, 1977

[51] Int. Cl.[2] ..... E06B 9/208

[52] U.S. Cl. ..... 160/296; 160/299

[58] Field of Search ..... 160/291–301; 188/184, 185, 187

[56] References Cited

U.S. PATENT DOCUMENTS

| | | | |
|---|---|---|---|
| 310,595 | 1/1885 | Lake | 160/299 |
| 575,572 | 1/1897 | Parsons | 160/296 |
| 1,162,411 | 11/1915 | Speer | 188/185 |
| 1,531,926 | 3/1925 | Hallot | 160/185 |
| 2,031,473 | 2/1936 | Fay | 160/297 |
| 2,040,301 | 5/1936 | Fay | 160/296 |

*Primary Examiner*—Peter M. Caun

*Attorney, Agent, or Firm*—Holman & Stern

[57] ABSTRACT

A braking device for roller blind spring loaded rods compressing a sleeve affixed to the end of the rod carrying therein several radially movable weight segments. The shaft upon which the rod rotates carries at least one non-rotatable braking element. The centrifugal force generated on the weight segments upon a rapid rotation of the rod forces the segments to press against the braking elements slowing the rod down by friction braking. The braking elements can be flange discs mounted on or affixed to the shaft.

5 Claims, 6 Drawing Figures

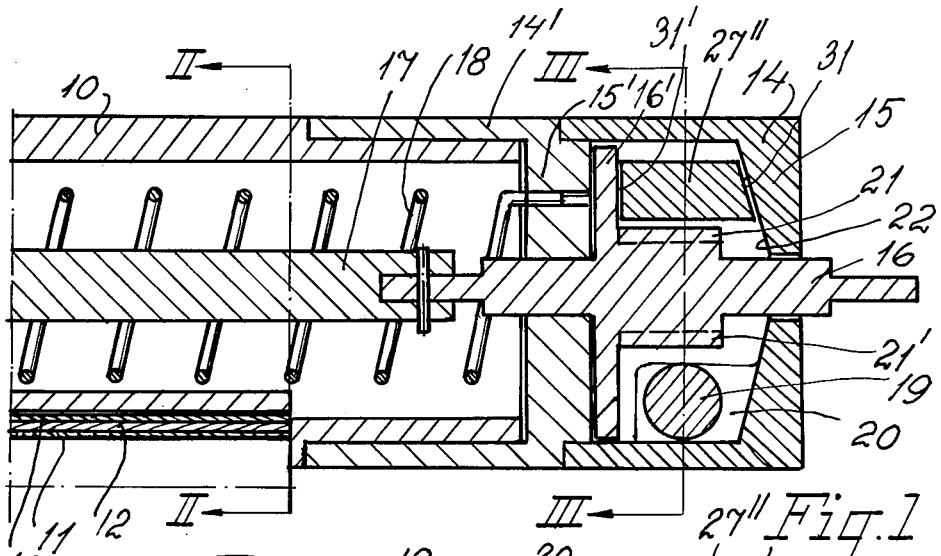
Fig. 1
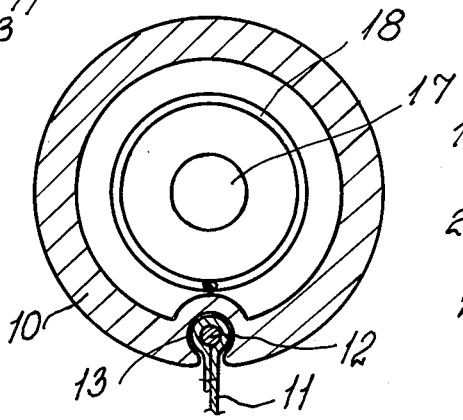
Fig. 2
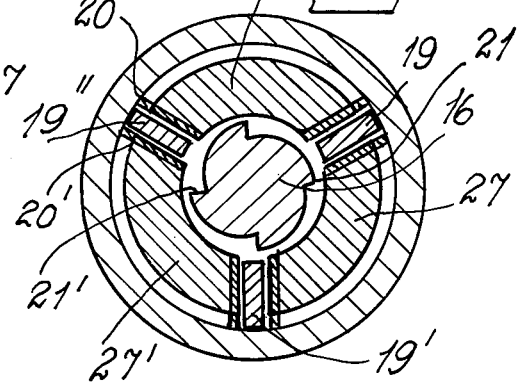
Fig. 3
Fig. 4
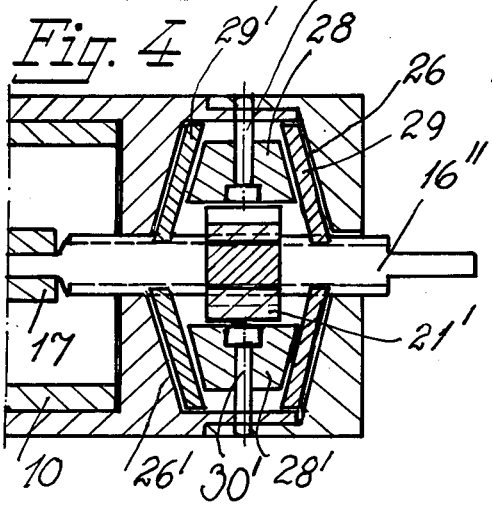
Fig. 5a
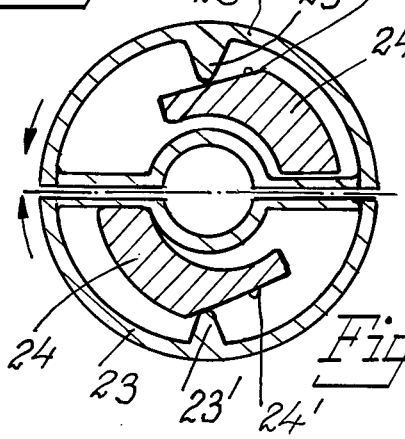
Fig. 5b

BRAKE DEVICE FOR ROTATABLE AND SPRING LOADED RODS, FOIL OR CLOTH MATERIAL BEING ATTACHABLE TO SAID RODS

The present invention relates to a brake device for rotatable and spring loaded rods or pipes, foil or cloth material being attachable to said rods for forming roller blinds, or similar. In roller blinds, there are arranged latch members that automatically lock the rotation of the rods or pipes when the foil or cloth material by manual pulling has been unrolled to some extent, whereby spring members arranged in the rods or pipes are tensioned during said unrolling. The latch members are released by being effected by the centrifugal force during the rotation of the rods or pipes obtained by said manual pulling or by the spring tension. When the rotation of the rods or pipes is stopped, the latch members are activated and thereby lock the rods or pipes in a certain position so that the further rotation thereof is prevented. Due to the fact that the tension of the spring members increases continuously when unrolling foil or cloth material by manual pulling, the rolling up is very fast accelerating when the pulling action is quickly ceased, for instance when the pulling member is released. Frequently, such quick rolling up produces damage, partly on the roller blind and partly on the fasteners thereof at walls and the similar.

Therefore, there has been a need for braking of the fast rotation of the rods or pipes, the reason for the rotation being the strong spring tension when rolling on foil or cloth material after a sudden releasing of the pulling action.

By means of a brake device according to the present invention, this need is fulfilled in an extremely simple and efficient manner.

The brake device according to the invention is intended for rotatable and spring loaded rods or pipes, to which rods or pipes flexible foil or cloth material being attachable. The rods or pipe is provided with at least one latch device for locking and releasing the rotation of the bar of pipe, and furtheron, each rod or pipe is rotatably movable around at least a shaft extending from one end portion thereof. The shaft is unrotatably mountable in a fixedly attachable support, therein. The brake device is characterized in that it comprises a sleeve fixedly mounted at the end portion of the rod or pipe being provided with said shaft, in which sleeve being arranged one or several movable weight segments, which by being affected by the centrifugal force at the rotation of the bar of pipe are pressed for clamping action against braking elements unrotatably arranged on the shaft for hereby providing friction braking of the rotation of the rod of pipe.

Furtheron, the brake device is characterized in that the sleeve is provided with two transversal walls spaced from each other and provided with a bearing hole for the shaft, at least one of said walls being provided with a conical surface against which the weight segments and/or the braking elements may abut or may be axially displaceable.

Three embodiments of the brake device according to the invention will be further elucidated with reference to the accompanying drawing, where FIGS. 1, 2 and 3 disclose the first embodiment, while FIG. 4 discloses the second embodiment and FIGS. 5*a* and 5*b* discloses the third embodiment.

FIG. 1 shows a longitudinal section of an end portion of the rod or pipe to which the sleeve provided with the brake device fixedly is attached.

FIG. 2 shows a cross section of the rod formed from a pipe along the line II—II in FIG. 1.

FIG. 3 shows a cross section of the sleeve and brake device along the line III—III in FIG. 1.

FIG. 4 is a longitudinal section of a portion of one end portion of the bar and the sleeve provided with the brake device according to the second embodiment.

FIG. 5*a* is a cross section of the brake device according to the third embodiment during, the rolling-up of the foil or cloth material.

FIG. 5*b* is a cross section of the third embodiment during the unrolling of the foil or cloth material.

In the Figures the reference numeral 10 denotes the rod or pipe onto which the flexible foil or cloth material 11 is attached. In this case the attachment is obtained by a wire 12 of metal or plastic around which one end portion of the foil or cloth material 11 is folded, whereafter this portion together with the wire 12 is inserted into a groove 13 extending in the longitudinal direction of the rod or pipe 10, the cross section of the groove being smaller at the surface of the rod or pipe 10 than at the bottom portion of the groove. Thus, the foil or cloth material is quickly attachable without the need of nails or the like.

At one end portion of the rod or pipe 10 a sleeve 14, 14' is fixedly attached. The sleeve is mountable into two pieces and is provided with two walls 15 and 15' arranged in the transversal direction and spaced from each other. The walls are provided with bearing holes for a shaft 16 unrotatably arranged in a support on a wall portion, the rod or pipe 10 being rotatable around the shaft. In a manner known per se, the shaft 16 is attached to a guiding rod 17 at the end thereof facing the mid portion of the rod or pipe 10. The guiding rod 17 is surrounded by a coil spring 18 one end of which is mounted in the guiding rod 17 and the other end is mounted in the one transverse wall 15' of the sleeve 14, 14', whereby the coil spring 18 continuously is tensioned when the foil or cloth material 11 is unrolled from the rod or pipe 10 by manual pulling.

Between the two transverse walls 15, 15' of the sleeve 14, 14' and in the shaft 16 there is arranged an automatically operating latch device for temporarily preventing the rotation of the rod or pipe 10 when the unrolling or rolling on of the foil or cloth material 11 has reached a certain fixed position.

As disclosed in FIGS. 1 and 3, the latch device comprises a number of round latch discs 19, 19', 19'' which are radially displaceable between guiding walls 20, 20' arranged in the one portion 15 of the sleeve and which may be engagable with teeth formed recesses 21, 21' in the shaft 16. At the rotation of the rod or pipe 10, the latch discs 19, 19', 19'' are displaced from engagement with recesses 21, 21' in the shaft 16 due to centrifugal force, but when the rotation of the rod or pipe 10 is stopped, one or two of the latch discs are displaced to engage with one or two of the recesses 21, 21' in the shaft 16 due to gravity, whereby a temporarily locking of the rotation of the bar of pipe is obtained.

The locking may also be obtained in a manner known per se by swingeable hooks which are brought into engagement with and out of engagement with similar recesses in a shaft when similar force conditions prevail.

In the embodiment according to FIG. 4, only the portion of the latch device provided with recesses is shown and in the embodiment according to FIG. 5 no portion of the latch device is disclosed.

The essential part of the invention is the brake device, by means of which a too quick rolling on of foil or cloth material 11 efficiently is prevented.

In FIGS. 1 and 3 an embodiment of the brake device is disclosed, where the external transverse wall 15 of the sleeve 14, 14' is provided with a conical surface 22 on the internal side thereof, so that the wall 15 is inclined relative the center of the sleeve 14, 14'. The shaft 16 is provided with a plane brake disc 16' which can be brought into engagement with the wall 15'. Between the wall 15 and brake disc 16' and between the guide walls 20 and 20', there are arranged radially displaceable weight segments 27, 27', 27'', each of which is provided with an inclined surface 31 which can be brought into engagement with the conical inner surface of the wall 15. The weight segments 27, 27', 27'' are also provided with plane surfaces 31' which can be brought into engagement with the brake disc 16'.

When the rod or pipe 10 is brought into a fast rotation, i.e. when the foil or cloth material 11 is rolled onto the rod or pipe 10, for instance when manually releasing the tension force, the weight segments 27, 27', 27'' are displaced against the periphery of the sleeve 14, 14'. The inclined surfaces 22 and 31 of the sleeve 14, 14' and the weight segments 27, 27', 27'' will press the weight segments 27, 27', 27'' against the brake disc 16' which implies that the shaft 16 is displaced axially so that the brake disc 16' is brought into abutment against the wall 15' of the sleeve 14, 14'. Thus, a braking action against the rotation of the rod or pipe 10 is obtained. This braking action is obtained automatically at a predetermined rotational speed, which thereby is maintained, and this implies the great advantage in that for instance a roller blind and the fastening members thereof or other elements cannot be damaged.

In the embodiment according to FIG. 4 the sleeve is provided with two conical surfaces 26, 26' which are spaced from each other and against which may be brought two conical brake discs 29, 29' with braking action, the discs being axially displaceable on a non-rotatable shaft 16'' around which the rod or pipe 10 is arranged for rotation, in the same manner as in the embodiment according to FIGS. 1, 2 and 3. The brake discs 29, 29' are not rotatable around the shaft 16'', but are mounted by means of pins into longitudinal grooves formed in the longitudinal direction of the shaft 16''.

Between the brake discs 29, 29' a number of weight segments 28, 28' are arranged for radial displacement, each one of said segments being provided with two inclined surfaces that by tension may be engaged with the brake discs 29, 29'. Radially through the sleeve, guide pins 30, 30' are mounted, and on the pins the weight segments 28, 28' are displaceable. When the rod or pipe 10 rotates, the weight segments 28, 28' are pressed against the periphery of the sleeve due to the centrifugal force, which implies that the brake discs 29, 29' are displaced against the conical surfaces 26, 26' of the sleeve, whereby braking action against too fast rotation of the rod or pipe 10 is obtained. The latch device 21' of the type previously mentioned, is of course also arranged in this embodiment.

The embodiment according to FIGS. 5*a* and 5*b* discloses in cross section two halves of the sleeve 23, and in each one of the halves a weight segment 24 is freely movable, in the same way as the weight segments 28, 28' in FIG. 4. The segments are provided with inclined surfaces which may be brought into engagement with brake discs 29, 29' or conical surfaces 26, 26' in the transverse walls of the sleeve. When rotating the rod or pipe 10 for rolling on the foil or cloth material 11 according to FIG. 5*a* showing the upper half of the sleeve, the weight segment 24 is displaced against the periphery of the sleeve, whereby brake action is obtained in the same manner as in FIG. 4. When the rod or pipe 10 is rotated in the opposite direction, i.e. when the foil or cloth material 11 is unrolled from the rod or pipe 10, the position being shown in FIG. 5*b*, the weight segment 24 is brought out of engagement with said brake disc 29, 29' or conical surfaces 26, 26'. This action is obtained due to the fact that a bead 23' is provided in the internal circular wall of each sleeve half, and against the bead a wedge shaped portion and surface 24' of the weight segment 24 is brought into engagement. The braking action is needed only when the foil or cloth material 11 is to be rolled onto the rod or pipe 10. Also in this embodiment as previously described, a latch device may be used.

Thus, the essential part of the invention is the brake device which prevents inadvertent fast rotation of the rod or pipe 10 upon a sudden release of the latch device, for instance when the manual pulling force in the foil or cloth material 11 is ceased while the spring is under strong tension.

Modifications and combinations of the brake device according to the invention are of course possible within the scope of the inventive idea and the accompanying claims. The wedge acting brake action due to the centrifugal force is the essential point of the invention.

I claim:

1. A brake device for rotatable and spring loaded rods or pipes (10), to which rods or pipes being attached a flexible foil or cloth material (11), each rod or pipe (10) being provided with at least one latch device (19,20,21) for locking and releasing the rotation of the rod or pipe (10), and furtheron, each rod or pipe (10) being rotatably movable around at least one shaft (16,16') extending from one end portion thereof, said shaft being unrotatably mountable in a fixedly attachable support, characterized in that the brake device comprises a sleeve (14,14',23) fixedly mounted to the end portion of the rod or pipe (10) being provided with said shaft, in which sleeve being arranged at least one radially movable weight segment (27,27', 27'',24,28,28') which by the action of the centrifugal force at the rotation of the rod or pipe (10) is moved radially to act against at least one braking element (16',22,29,29') arranged non rotably on the shaft (16,16'') whereby braking of the rotation speed of the rod or pipe (10) is provided by friction action being established between said at least one segment and said at least one element.

2. A brake device according to claim 1, comprising at least two braking elements (29,29') which each comprise a flange disc (29, 29') unrotatably arranged on the shaft (16,16'').

3. A brake device according to claim 2, characterized in that the braking elements (29,29') are arranged axially displaceable on the shaft (16,16'').

4. A brake device according to claim 1, characterized in that the sleeve (14, 14') is provided with two transverse walls (15, 15') spaced from each other and provided with bearing holes for the shaft (16, 16''), whereby at least one wall (15) is provided with a conical surface (22), against which the at least one weight segment (28, 27′, 27″) and/or the at least one braking element (26, 26′) is engageable and axially displaceable.

5. A brake device according to claim 4, comprising at least two braking elements and wherein each weight segment (24, 28, 28′) is provided with two opposite inclined surfaces which are engageable under pressing action against the braking elements or the conical surfaces of the transverse walls.

* * * * *